US005487336A

United States Patent [19]

Simeth

[11] Patent Number: 5,487,336

[45] Date of Patent: Jan. 30, 1996

[54] SUSPENSION FOR A DEVICE SERVING AS A GUARD IN FRONT OF THE PRINTING-UNIT CYLINDERS OF A PRINTING MACHINE

[75] Inventor: Claus Simeth, Geisenheim, Germany

[73] Assignee: MAN Roland Druckmaschinen AG, Germany

[21] Appl. No.: 410,347

[22] Filed: Mar. 24, 1995

[30] Foreign Application Priority Data

Mar. 25, 1994 [DE] Germany ..... 44 10 305.0

[51] Int. Cl.[6] ..... B41F 33/14

[52] U.S. Cl. ..... 101/216; 101/477

[58] Field of Search ..... 101/212, 216, 101/219, 477; 100/53; 192/129 R, 133, 134

[56] References Cited

U.S. PATENT DOCUMENTS 4,295,421 10/1981 Abendroth et al. ..... 101/216

5,113,762 5/1992 Abendroth et al. ..... 101/350

5,289,775 3/1994 Spiegel et al. ..... 101/477

5,373,787 12/1994 Junghans et al. ..... 101/216

*Primary Examiner*—Ren Yan

*Attorney, Agent, or Firm*—Leydig, Voit & Mayer, Ltd.

[57] ABSTRACT

A guard mechanism for a printing machine which includes a guard plate that is movable between a first position which impedes access to the interior of the printing machine and a second position which permits access to the interior of the printing machine and the plate cylinder and ink fountain located therein, the guard plate having an articulated connection with to the ink fountains such that upon movement of the ink fountain to a throw-off position the guard plate is simultaneously moved to a position which prevents the possibility of interference between movement of the guard plate and ink fountain.

11 Claims, 2 Drawing Sheets

SUSPENSION FOR A DEVICE SERVING AS A GUARD IN FRONT OF THE PRINTING-UNIT CYLINDERS OF A PRINTING MACHINE

FIELD OF THE INVENTION

The present invention relates generally to a movable guard mechanism for preventing access to internal components of a printing machine, and more particularly, to a guard mechanism for printing machines having an ink fountain that is moveable between an operative position adjacent an ink roller and a throw-off position removed from the ink roller for permitting cleaning and maintenance of the ink fountain and other components of the printing machine.

BACKGROUND OF THE INVENTION

In presently available printing machines, such as the product line R 700 commercially sold by MAN Roland Druckmaschinen AG, a vertically movable guard is provided which covers approximately one-half the height of the printing unit on the delivery side of a printing unit. Above the vertically movable guard, further protection is provided in front of the inking-unit rollers and the ink fountain when in their normal operating positions. The vertically movable guard is supported by linear guides attached to side pillars of the machine frame on the drive and service sides and is actuated via a pneumatic working cylinder.

DE 42 24 832 A1 discloses a device which is vertically movable as a guard in front of the printing-unit cylinders of the printing machine and which is designed as a magazine for the automatic changing of printing plates. This magazine is pivotable about a horizontal shaft, with the shaft being guided at each of its opposite ends in a linear guide attached to the side pillars at the drive side and service side of the machine. As can be seen particularly from FIG. 2 of this publication, the entire height of this magazine covers the printing unit. Therefore care must be taken to avoid that an ink fountain located in the upper end part of the printing unit is moveable between its aperture and thrown-off positions without coming into the path of movement of the magazine.

An ink fountain mounted so as to be capable of being thrown on and thrown off relative to an ink-fountain roller is known from DE 40 12 949 C1. This throw-on and throw-off mounting of an ink fountain relative to an ink-fountain roller serves, as is known, for the cleaning and maintenance of the ink fountain or the metering elements cooperating with the ink-fountain roller.

OBJECTS AND SUMMARY OF THE INVENTION

It is an object of the present invention to provide a printing machine having a movable guard mechanism for preventing access to the printing unit cylinders which prevents the possibility of interference with an ink fountain of the printing machine when the ink fountain is moved to a throw-off position.

Another object is to provide a printing machine with a guard mechanism as characterized above in which a guard plate of the mechanism may be raised and lowered between a first position preventing access to the printing unit cylinders and a second position permitting access thereto, and which guard plate also is pivotable simultaneously with movement of the ink fountain from its operating position to its throw-off position for preventing the possibility of interference between the ink cylinder and the guard plate.

A further object is to provide a printing machine guard mechanism of the foregoing type which is relatively simple in construction and operation and which lends itself to economical manufacture.

Other objects and advantages of the invention will become apparent upon reading the following detailed description and upon reference to the drawings, in which:

BRIEF DESCRIPTION OF THE DRAWINGS

FIG. 2(*b*) is a schematic of the guard mechanism shown in FIG. 1, wherein the fountain is in its throw-off or non-operating position.

Figure 1:
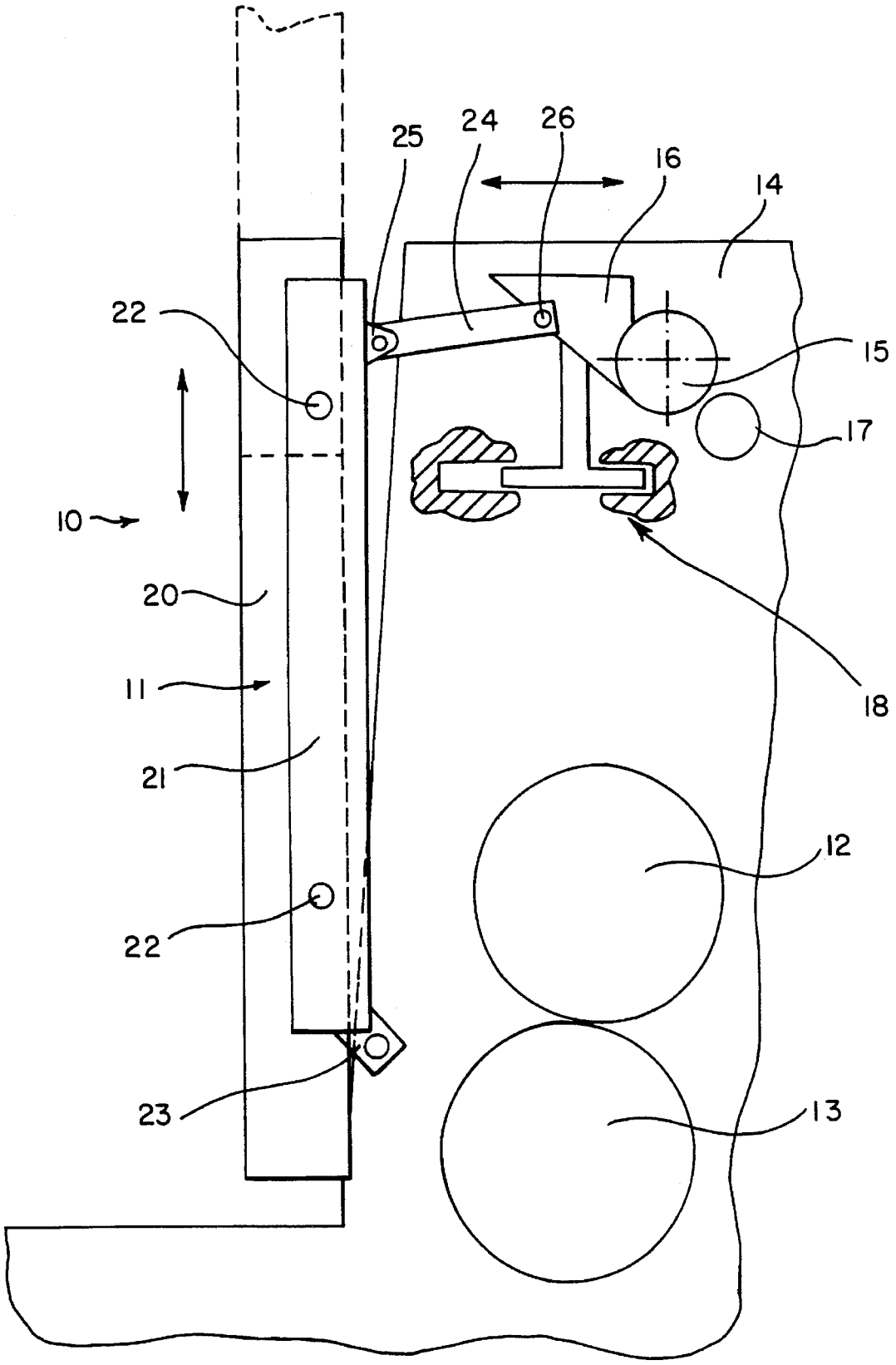
FIG. 1 is a schematic, side elevation, in partial section, of a printing machine having a guard mechanism in accordance with the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to the drawings, there is shown an illustrative printing machine 10 having a guard mechanism 11 in accordance with the invention. The printing machine includes a plate cylinder 12 and a blanket cylinder 13 mounted in a known manner between side pillars 14 of the machine frame.

Figure 2A:
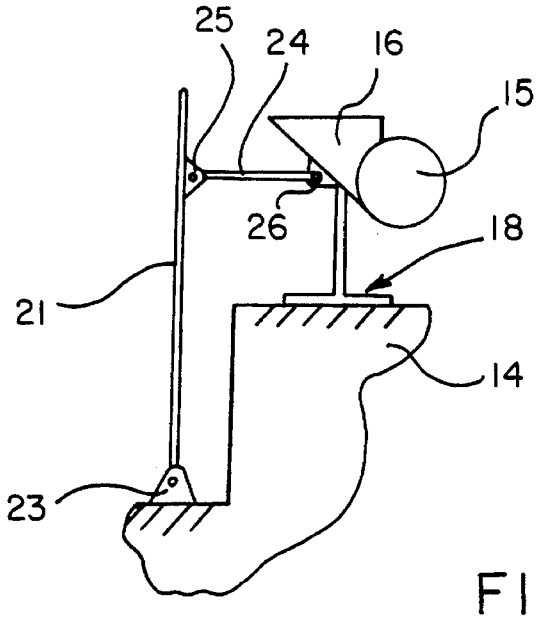
FIG. 2(*a*) is a schematic of the guard mechanism shown in FIG. 1, wherein the ink fountain is in its operating position.
Figure 2B:
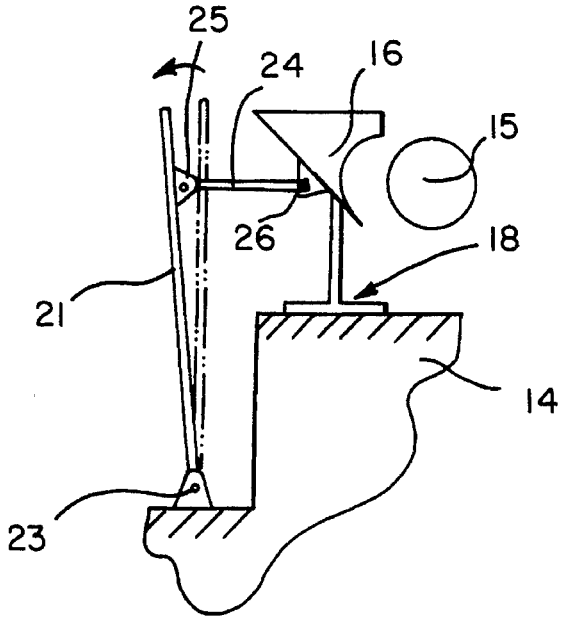

For supplying ink to the blanket and plate cylinders 13, 12, an ink fountain roller 15 cooperates with an ink fountain 16 and communicates ink through transfer ink rollers 17 (partially shown) to the plate cylinder 12 in a known manner. For allowing the ink fountain 16 to be thrown onto and off of the ink fountain roller, the ink fountain 16 is slidably mounted on a support 18 attached to the side pillars 14. The ink fountain 16 thereby can be moved between its operative position, as shown in FIGS. 1 and 2*a*, and a thrown-off position, as shown in FIG. 2*b*.

To prevent access to the moving parts of the printing machine, a guard mechanism 11 is provided which includes a guard plate 20 that serves as a barrier against encroachments into the region of the printing unit cylinders 12, 13 and ink fountain 16. The guard plate 20 in this instance is in the form of a printing plate magazine adapted to facilitate automatic changing of printing plates. It will be understood by one skilled in the art that appropriate means may be located and supported between the side pillars 14 of the machine frame for feeding a printing plate from the plate cylinder into the magazine and for presenting a new plate from the magazine to the plate cylinder 12.

In accordance with the invention, the guard plate is vertically movable between a closed protective position and a raised position which permits access to the interior of a printing machine and also is transversely movable simultaneously with movement of the ink fountain to its throw-off position so as to prevent the possibility of interference with the ink fountain. To this end, in the illustrated embodiment, the guard plate 20 is mounted for relative vertical movement on guide members 21 each located adjacent a respective one of the side pillars 14 of the machine frame. The guide members 21 may be in the form of guide channels each being adapted for slidably receiving a side of the guard plate for relative linear movement. Alternatively, the sides of the guard plate may have rollers 22 adapted for rolling movement in the guide member channels. It will be seen that with such guard plate mounting, the guard plate 20 may be lifted in a substantially vertical direction from its lower closed position to a raised position, shown in phantom in FIG. 1, for permitting access to the interior of the printing machine.

In carrying out the invention, the guard plate has an articulated connection with the machine frame and the ink fountain such that as the ink fountain is moved to its thrown-off position the guard plate is simultaneously moved to an outwardly removed position which prevents the possibility of the ink fountain 16 from interfering with movement of the guard plate 20 between its lowered and raised positions. The guide members 21 in the illustrated embodiment are pivotally mounted to the side pillars 14 of the machine frame in rotary joints 23, and linkage arms or members 24 connect the upper ends of the guide members 21 to the ink fountain 16 by means of articulated rotary joints 25 and 26. It will be seen that the guide members 21, linkage members 24, ink fountain 16, and the side pillars 14 each define a respective four bar or side mechanism for controlling the simultaneous movement of the ink fountain and guard plate.

As shown in FIGS. 2*a* and 2*b*, the guide members 21 and the guard plate 20 carried thereby may be articulated between a first position in which the ink fountain 16 is in its operating position (i.e., in communication with the ink fountain roller 15) and the throw-off position (i.e., the fountain is not in communication with the ink fountain roller 15). By means of the linkage members 24, pivotal articulation of the guide members 21 will effect movement of the ink fountain 16 into and out of its operating position. As illustrated, the guide member 21 and the guard plate 20 preferably are in substantially vertical position when in their first or closed positions, and are pivoted to a slightly open position when the ink fountain 16 is moved to its throw-off position.

Thus the guard plate 20 may be raised or lowered, even when the ink fountain is in its throw-off position without a restriction occurring in the throw-off path of the ink fountain and without an interference occurring between the raising and lowering movement of the guard plate. The guard mechanism of the printing machine thus overcomes the drawbacks inherent in the prior art.

What is claimed is:

1. A printing machine comprising:

a frame; a plate cylinder supported within said frame; an ink fountain for storing printing ink; transfer rolls for transferring printing ink from said ink fountain to said plate cylinder, said transfer rolls including an ink fountain roller, said ink fountain being moveable between an operating position in which said ink fountain roller communicates with said ink fountain and a throw-off position in which said ink fountain roller does not communicate with said ink fountain; a guard mechanism for impeding access to said plate cylinder and ink fountain from outside of said printing machine, said guard mechanism including a guard plate, said guard plate being movable independently of said ink fountain between a first position which impedes access to the interior printing machine and the plate cylinder and ink fountain located therein and a second position which permits access to an interior of said printing machine and said plate cylinder and ink fountain, and said guard plate being connected to said ink fountain such that upon movement of said ink fountain to said throw-off position said guard plate is simultaneously moved to a position which prevents the possibility of said ink fountain from interfering with movement of said guard plate between its first and second positions and which prevents the possibility of said guard plate from interfering with movement of said ink fountain from said operating position to said throw-off position.

2. The printing machine of claim 1 in which said guard plate is pivotally moveable to an outwardly pivoted position simultaneously with movement of said ink fountain from said operating position to said throw-off position.

3. The printing machine of claim 1 including a pair of guide members, said guard plate being supported for relative linear movement by said guide members between said first and second positions, and said guide members and guard plate being simultaneously movable with said ink fountain when said ink fountain is moved between said operating and throw-off positions.

4. The printing machine of claim 3 in which said guide members and guard plate are pivotally movable to an outwardly pivoted position simultaneously with movement of said ink fountain from said operating position to said throw-off position.

5. The printing machine of claim 4 in which a pivot joint supports a lower end of each of said guide members for pivotal movement relative to said frame.

6. The printing machine of claim 5 in which a linkage arm connects between an upper end of each of said guide members and said ink fountain.

7. The printing machine of claim 6 in which pivot joints connect opposite ends of said linkage arms with said guide member and said ink fountain.

8. The printing machine of claim 6 in which the guide members, linkage ,arms, ink fountain, and frame defines a four side mechanism for controlling simultaneous movement of the ink fountain and guard plate.

9. The printing machine of claim 3 in which said guide members are channels which each receive and support a respective side of said guard plate.

10. The printing machine of claim 9 in which said opposite sides of said guard plate have rollers disposed for rolling movement within said guide member channels.

11. The printing machine of claim 1 in which said guard plate is a magazine for containing printing plates for said plate cylinder.

* * * * *